US007293958B2

(12) United States Patent
Kraffzik

(10) Patent No.: US 7,293,958 B2
(45) Date of Patent: Nov. 13, 2007

(54) CENTRIFUGAL PUMP

(75) Inventor: Hans-Juergen Kraffzik, Bielefeld (DE)

(73) Assignee: Aweco Appliance Systems GmbH & Co. KG, Neukirch (DE)

( * ) Notice: Subject to any disclaimer, the term of this patent is extended or adjusted under 35 U.S.C. 154(b) by 321 days.

(21) Appl. No.: 11/071,177

(22) Filed: Mar. 4, 2005

(65) Prior Publication Data

US 2005/0201878 A1 Sep. 15, 2005

(30) Foreign Application Priority Data

Mar. 5, 2004 (DE) ..... 10 2004 011 365

(51) Int. Cl.
*F04D 29/42* (2006.01)

(52) U.S. Cl. ..... 415/206; 415/207

(58) Field of Classification Search ..... 415/175, 415/206, 207

See application file for complete search history.

(56) References Cited

U.S. PATENT DOCUMENTS 4,594,500 A * 6/1986 Wright ..... 392/471
5,156,524 A * 10/1992 Forni ..... 415/182.1
5,701,388 A 12/1997 Steinhardt
6,779,974 B2 * 8/2004 Chien ..... 415/206

FOREIGN PATENT DOCUMENTS

| | | |
|---|---|---|
| DE | 28 03 815 A1 | 8/1978 |
| DE | 33 04 265 A1 | 8/1983 |
| DE | 199 16 136 A1 | 10/2000 |
| DE | 103 24 626 A1 | 3/2002 |

* cited by examiner

*Primary Examiner*—Ninh H. Nguyen
(74) *Attorney, Agent, or Firm*—Breneman & Georges

(57) ABSTRACT

A centrifugal pump (1) is proposed, in particular for household appliances, such as washing machines or dishwashers, which comprises a pump housing (2) having an axial inlet (11), an outlet (12) and a heating element, wherein the pump housing (2) incorporates a rotatably mounted impeller (4) and a flow channel (15) enveloping the impeller (4) and heating element. The centrifugal pump (1) according to the invention is intended to have improved efficiency. This is achieved by having the flow cross-section of the flow channel (15) increase along the periphery toward the outlet (12).

16 Claims, 3 Drawing Sheets

CENTRIFUGAL PUMP

BACKGROUND OF THE INVENTION (1) Field of the Invention

The invention relates to a centrifugal pump, in particular for household appliances with a pump housing having an inlet, an outlet and a heating element to provide a flow channel that envelops the impeller of the pump and heating element.

(2) Description of the Related Art Including Information Disclosed Under 37 C.F.R. 1.97 and 1.98

In household appliances, such as dishwashers or washing machines, centrifugal pumps are normally used to circulate the cleaning liquid. To economize on separate heating elements, centrifugal pumps that integrate a heating element into the liquid pump have also become known (see DE 199 16 136).

Another known centrifugal pump also has a flow channel that envelops the impeller and the heating element or its receptacle in the housing cover (see DE 103 24 626 A1).

In the centrifugal pumps described above, the heating element is frontally arranged on a cover of the pump housing, which places corresponding limitations on the configuration of such a pump that might negatively affect its efficiency.

SUMMARY OF THE INVENTION

The objective of the invention is to propose a centrifugal pump with integrated heating element in which pump efficiency is improved relative to prior art.

This objective is achieved proceeding from a centrifugal pump of the kind mentioned at the outset by a heating element integrated with the pump to provide a flow channel that envelops the impeller of the pump and heating element.

The advantages of the invention include modification of the axial dimensions of the flow channel, arranging the heating element axially adjacent to the impeller, sloping the flow channel, disposing a heating element on the side of the impeller facing the axial inlet of the pump housing, providing an annular design for the heating element, providing a circular pump housing, utilizing a continuous inlet gap, providing an annular inlet gap, increasing the volume of the impeller, matching the impeller to the profile of the heating element and adding an axial inlet support.

Accordingly, a centrifugal pump based on the invention is characterized in that the flow channel enveloping the impeller and heating element increases along the periphery toward the pump outlet.

This measure makes it possible to tangibly increase the maximum volume flow, and hence the efficiency, of the centrifugal pump. A smaller centrifugal pump can hence be used, resulting in corresponding production and operation-related savings.

Since the flow channel outwardly envelops not just the impeller, but also the heating element, the cleaning liquid to be heated necessarily flows over the heating element or its receptacle in the pump housing over a very large contact surface and at a high volume rate. This yields a good heater efficiency, which can as a result be brought into thermal contact with the cleaning liquid on over 75% of its surface, for example, or, given a corresponding cross sectional design, over an even greater percentage.

In a further development of the invention, the flow cross section of the flow channel is increased by changing the axial dimension of the flow channel. This makes it possible to realize a particularly compact pump.

In a special embodiment of the invention, the heating element is arranged at least partially next to the impeller in an axial direction. This makes it possible to realize a flow channel with an axial dimension that allows it to envelop both the impeller and heating element, and permits the advantageous heating element flow described above.

In addition, it is preferred that the increase in the flow channel axial dimension be made on the side opposite the heating element along the periphery toward the outlet. This is advantageous in particular with the heating element arranged in an axial direction next to the impeller, since the heating element limits the number of ways the pump can be configured in the direction toward the heating element.

In addition, the flow channel is provided with a sloped bottom in a special embodiment. Sloping the bottom, i.e., the end facing away from the heating element, of the flow channel makes it possible to influence the flow conditions, in particular at the transition to the outlet. Outwardly increasing the slope of this channel bottom enables a smooth transition to the outlet without any flow-disrupting offsets, for example.

The heating element is advantageously arranged on the side of the impeller facing the axial inlet of the pump housing. In this way, the impeller drive can be actuated from the other side, without the drive and heating element or heating element connections having a disruptive influence.

In addition, the heating element advantageously has at least a partially annular design. Such a ring or partial ring can be concentrically applied to a face of the pump housing, so that the rotary flow inside the pump housing can be used to achieve a good flow toward the heating element or its receptacle in the pump housing. In particular, the rotary pump flow also enables the stream to pass over the outside of the heating element. In the embodiment described above, in which the heating element is arranged on the side of the impeller facing the axial inlet of the pump housing, the heating element thus at least partially envelops the axial inlet of the pump housing.

In a further development of the invention, the pump housing is designed in such a way that the cross section of the pump housing perpendicular to the rotational axis of the impeller is essentially always circular. This type of pump housing design is made possible by the fact that the flow cross section of the flow channel is only increased by enlarging the axial dimension of the flow channel. Such a rotationally symmetrical configuration of the pump housing enables more favorable fabrication in comparison to a design with increasing radius. However, the radius of the pump housing can here indeed be variable along the rotational axis, i.e., the pump housing can be outwardly curved, or provided with a toroidal shoulder, if needed.

However, one particularly advantageous embodiment of the invention provides that the outside of the pump housing be essentially cylindrical in design. Such a cylindrical or tubular shape can be easily fabricated, e.g., by an injection molding process. In addition, such a pump can be manufactured with a compact outer shape, so that it can also be used accordingly under confined spatial conditions.

The interior of the flow channel is advantageously provided with a continuous inlet gap, which essentially has a constant height. This step makes it possible to improve the flow conditions, and hence the efficiency, of the pump. In particular, the so-called dead volume can be limited in this way.

These advantages are achieved in particular in combination with an impeller having an annular gap lying at the height of the inlet gap of the flow channel. The liquid pushed to the outside by centrifugal forces from the rotating impeller is here forced directly into the flow channel, wherein corresponding impeller blades impart not just a radial motion to the liquid, but also a circulating flow. The rising rotational radius of the cleaning liquid caused by centrifugal forces given an identical angular velocity due to exposure to the impeller blades additionally increases the velocity, and hence volume throughput.

To further improve pump efficiency, the impeller is preferably provided with an increasing volume in an axial direction. The impeller has a specific interior volume due to an upper and lower cover with blade elements lying in between, and its efficiency increases as does the volume of liquid that can be processed by the impeller. The volume in the impeller along with the impeller shape (in particular the blade shape) determines the energy conversion in the impeller.

In particular, in conjunction with the aforementioned features aimed at further developing the invention, an impeller widened in an axial direction is advantageous, since the pump housing has a corresponding volume in this direction for receiving an impeller enlarged in this way, owing to the increased axial dimension of the flow channel. This measure makes it possible to improve the efficiency accordingly. The impeller volume can be increased in this way by a corresponding bulge, for example.

In a further development of the invention, the side of the impeller facing the heating element is matched to the profile of the heating element or its receptacle in the pump housing. This diminishes the dead volume on the one hand, and hence improves pump efficiency. On the other hand, the overall dimensions of the pump are kept low as a result.

In addition, the pump inlet is provided with an inlet support in an advantageous embodiment, which extends into an inlet opening of the impeller. This improves the flow of the liquid to be conveyed into the impeller. Lateral flows are hereby prevented from passing by the impeller. The so-called dead volume of the pump is kept correspondingly low.

BRIEF DESCRIPTION OF THE SEVERAL VIEWS OF THE DRAWING(S)

An embodiment of the invention is depicted in the drawing, and will be explained in greater detail below based on the figures.

Shown specifically on:

Figure 1:
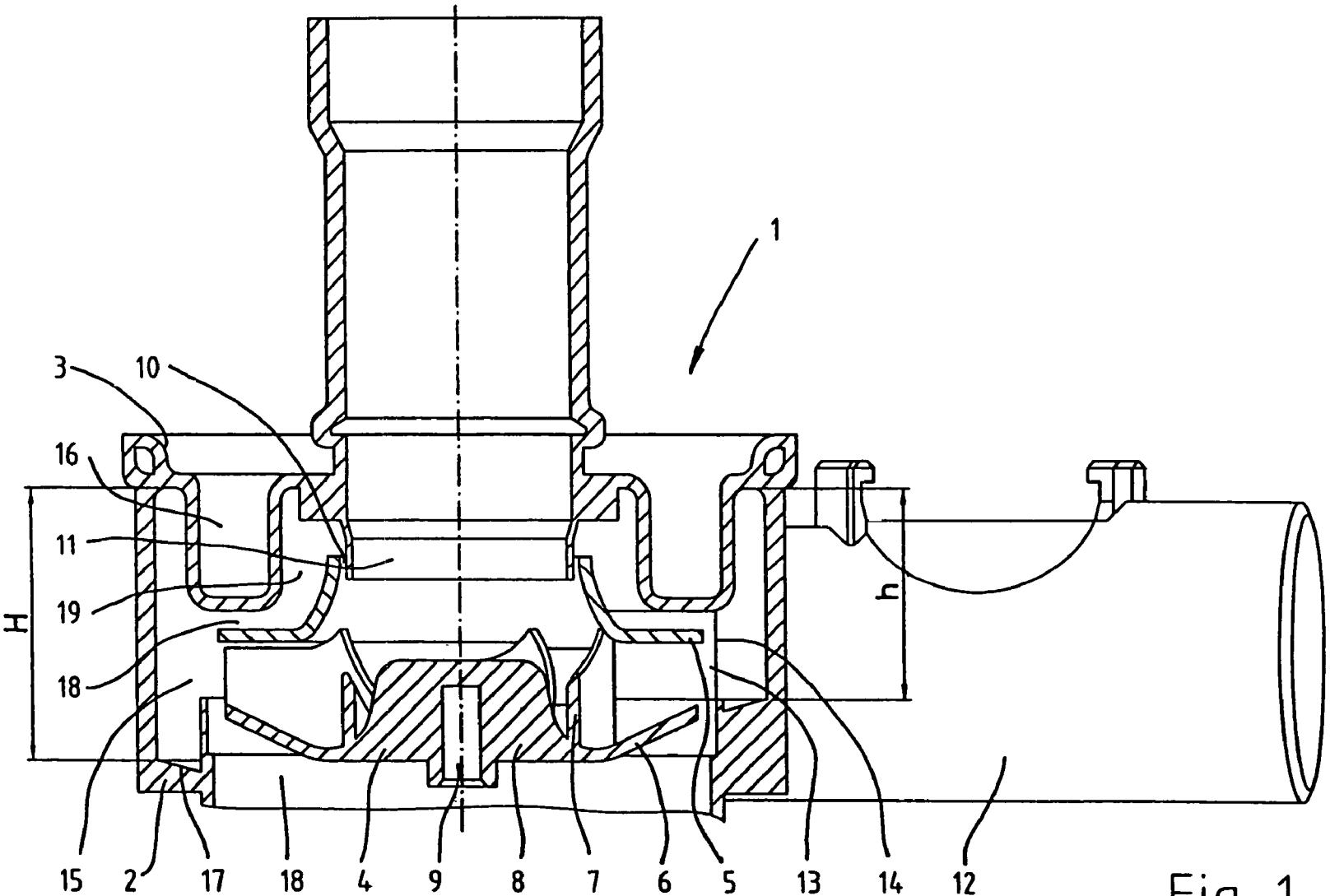
FIG. 1 is a longitudinal section through a pump according to the invention.

The pump 1 according to FIG. 1 comprises a cylindrical pump housing 2 having a cover 3 on its upper side. The cover 3 can accommodate the heating element not shown on FIG. 1, and to this end can be made out of a heat-conducting material, e.g., metal.

Located inside the pump housing 2 is an impeller 4, which essentially consists of a lower cover 5, 6 with blades 7 arranged in between. The blades 7 are curved and molded in such a way as go generate a corresponding annular flow of the liquid located in the impeller 4 as the impeller 4 rotates.

The bottom of the impeller 4 is provided with an axial projection 8, which is provided with a central hole 9 for accommodating a drive shaft (not shown in greater detail). The drive of the impeller 4 is hence actuated from the side opposite the heating element or the cover 3.

The top cover 5 has a central opening 10 into which the inlet support 11 extends. An outlet support 12 is placed behind the pump housing 2 in a tangential direction in the view according to FIG. 3.

The impeller 4 has an opening gap 13 on its edge, which lies opposite an inlet gap 14 of a flow channel 15 according to the invention at roughly the same height. The flow channel 15 extends at an axial height up to a groove 16 for accommodating the heating element, so that the liquid located in the flow channel 15 flows around the outside of not just the impeller 4, but also of the heating groove 16. As evident from FIG. 1, the heating groove 16 is correspondingly in contact with the liquid located inside the pump housing 2 on three sides, and hence over distinctly more than 75% of the available contact surface based on the larger height in comparison to the width of the heating groove 16.

FIG. 1 clearly shows the different axial dimension h, H of the flow channel 15 on both sides of the sectional view. This different axial dimension h, H is manifested in a continuous peripheral increase in height h until reaching height H. This increase takes place continuously in the cut off front section of the pump (not shown in the view according to FIG. 1), and ends in the rearward area at the transition into the outlet support 12.

The bottom 17 of the flow channel 15 is upwardly sloped toward the outside. It also exhibits a slight bulge. This shape facilitates the transition into the outlet support 12, as explained further above.

The bottom cover 6 of the impeller 4 is bulged to the extent that it clearly extends into the space 18 below the inlet gap 14, thereby using this volume of the pump housing 2 to increase the interior volume of the impeller 4. The round bulge of the bottom cover 6 here in turn serves to improve flow inside the impeller 4, i.e., to guide the water toward the inlet gap 14 of the flow channel 15.

The contour of the top cover 5 is matched to the cover 3 or heating groove 16. This shape of the top cover 5 further ensures a sufficient intermediate space 18, 19 between the top cover 5 and the heating groove 16. In this intermediate space 18, 19, heat can consequently also be transferred to the liquid present there.

Figure 2:
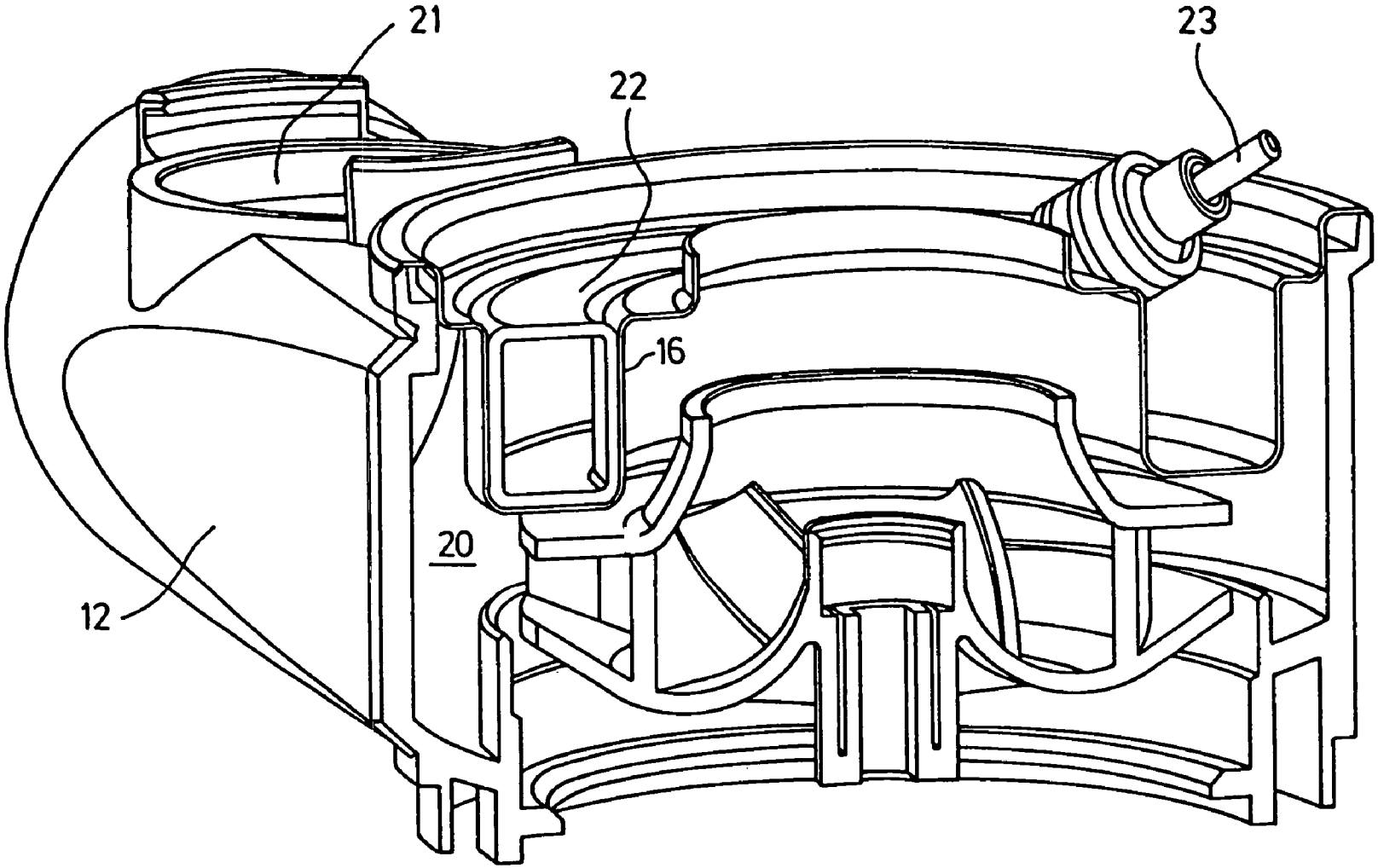
FIG. 2 is a perspective, sectional view of a pump according to FIG. 1.

The view according to FIG. 2 essentially corresponds to the embodiment illustrated in FIG. 1. Readily discernible in this view is the transition 20 to the outlet support 12, which has a receptacle 21 for a pressure sensor. As opposed to FIG. 1, this view also shows a heating element 22 consisting of a heating rod that has been bent into a ring segment and inserted into the heating groove 16. The end of the heating element 22 is upwardly bent, providing a connection 23 for the heating element 22.

The heating element 22 is form fitted to the heating groove 16, and additionally connected there in a thermally conductive manner, e.g., by a soldered contact.

Figure 3:
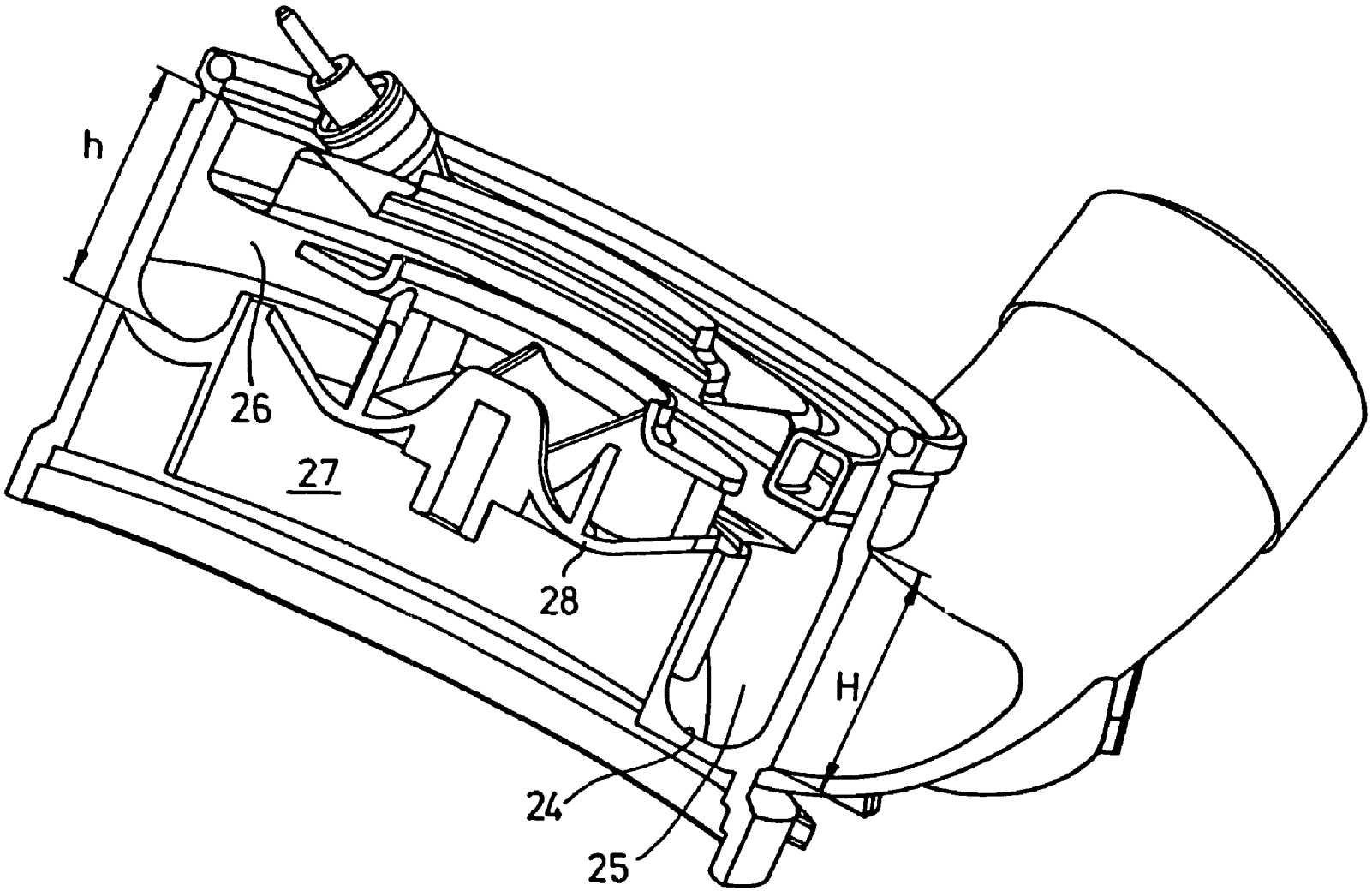
FIG. 3 is a perspective, sectional view of another embodiment of a pump according to the invention.

The embodiment according to FIG. 3 essentially corresponds to the pump described based on FIG. 2, the difference being that the bottom 24 of the outwardly running flow channel 25 is no longer sloped, but exhibits a round bulge. However, the increase in axial dimension h, H of the flow channel 25 is as readily discernible here as is the use of the interior space 27 available below the inlet gap 26 for increasing the volume of the impeller 28.

REFERENCE LIST

1 Pump
2 Pump housing
3 Cover
4 Impeller
5 Cover
6 Cover
7 Blade
8 Projection
9 Hole
10 Opening
11 Inlet support
12 Outlet support
13 Opening gap
14 Inlet gap
15 Flow channel
16 Heating groove
17 Bottom
18 Intermediate space
19 Intermediate space
20 Transition
21 Receptacle
22 Heating element
23 Connection
24 Bottom
25 Flow channel
26 Inlet gap
24 Interior space
28 Impeller

What is claimed is:

1. A centrifugal pump, for household appliances with a pump housing having an axial inlet, an outlet and a heating element, wherein the improvement comprises an axial inlet support (11) that extends into an inlet opening (10) of a rotatably mounted impeller having a flow channel enveloping the impeller (4) and heating element such that the flow cross section of the flow channel (15) increases along the periphery toward the outlet.

2. The pump according to claim 1 wherein the axial dimension (h, H) of the flow channel (15) increases along the periphery toward the outlet (12).

3. The pump according to claim 2 wherein the axial dimension (h, H) of the flow channel (15) increases on the side opposite the heating element (22) along the periphery toward the outlet (12).

4. The pump according to claim 1 or 2 wherein the flow channel (15) has a bottom (17) that is upwardly sloped toward the outside.

5. The pump according to claim 1 or 2 wherein the heating element (22) is arranged on the side of the impeller (4) facing the axial inlet (11) of the pump housing (2).

6. The pump according to claim 2 wherein the heating element (22) is of an annular configuration.

7. The pump according to claim 1 or 2 wherein the cross section of the pump housing (2) perpendicular to the rotational axis of the impeller (4) is circular.

8. The pump according to claim 1 or 2 wherein the heating element (22) is arranged in an axial direction at least partially next to the impeller (4).

9. The pump according to claim 1 wherein the outside of the pump housing (2) is of a circular configuration.

10. The pump according to claim 1 wherein the interior of the flow channel (15) has a continuous inlet gap (14) having about a constant height.

11. The pump according to claim 1 wherein the impeller (4) has an annular gap (13) disposed at roughly the height of the inlet gap (14) of the flow channel.

12. The pump according to claim 1 wherein the volume of the impeller (4) increases in an axial direction.

13. The pump according to claim 12, wherein the volume increase of the impeller (4) is arranged on the side of the impeller (4) facing away from the heating element (22).

14. The pump according to of claim 1 wherein the side of the impeller (4) facing the heating element (22) is matched to the profile of the heating element (22) or its receptacle (16) in the pump housing (2).

15. The pump according to claim 1 wherein said pump (1) is disposed in a washing machine or a dishwasher.

16. A household appliance centrifugal pump having a pump housing with an axial inlet, an outlet and a heating element, wherein the improvement comprises a rotatably mounted impeller having a flow channel enveloping the impeller and heating element such that the flow cross section of the flow channel (15) increases along the periphery toward the outlet and the flow channel (15) has a bottom (17) that is upwardly sloped toward the outside.

* * * * *